US006022236A

United States Patent [19]

McHugh et al.

[11] Patent Number: 6,022,236

[45] Date of Patent: Feb. 8, 2000

[54] ELECTRICAL TERMINAL

[75] Inventors: Robert G. McHugh, Evergreen, Colo.; Yao Chi Huang, Yung-Ho; Shih-Wei Hsiao, Kaohsiung, both of Taiwan

[73] Assignee: Hon Hai Precision Ind. Co., Ltd., Taipei Hsien, Taiwan

[21] Appl. No.: 09/138,843

[22] Filed: Aug. 24, 1998

[51] Int. Cl.[7] ..... H01R 4/50

[52] U.S. Cl. ..... 439/342; 439/259

[58] Field of Search ..... 439/342, 259, 439/513

[56] References Cited

U.S. PATENT DOCUMENTS 4,516,817 5/1985 Deters ..... 439/513

*Primary Examiner*—Michael L. Gellner
*Assistant Examiner*—Antoine Ngandjui

[57] ABSTRACT

An electrical terminal for use with a ZIF socket for electrically connecting a CPU to a printed circuit board comprises a terminal body forming a leg portion at a lower portion thereof. The terminal forms a first connecting arm and a second connecting arm extend from a side of an upper portion thereof. Each of the first and second connecting arms form a connecting portion for electrically connecting with a corresponding terminal.

8 Claims, 8 Drawing Sheets

ELECTRICAL TERMINAL

FIELD OF THE INVENTION

The present invention relates to an electrical terminal, and more particularly to an electrical terminal for use with a connector socket.

DESCRIPTION OF PRIOR ART

Taiwan Utility Model Application No. 83208396 (hereinafter referred to as the '396) discloses a terminal for use with a ZIF (zero-insertion-force) socket for mounting a CPU to a printed circuit board. The terminal comprises a terminal body, a leg extending downward from a first edge of the terminal body, an elastic arm extending upward from a second edge opposite the first edge, and a grasping plate integrally formed with an end of the elastic arm.

The socket for mounting the CPU includes a base member fixedly mounted onto the printed circuit board, and a cover member movably disposed on the base member. The terminal disclosed in the '396 patent is fixedly rooted on the base member of the socket whereby an array of terminals is formed. The cover member defines an array of through holes for insertion of connecting pins therethrough. The cover member is displaced by a lever mechanism between a first position in which the connecting pins of the CPU can be easily inserted the socket, and a second position in which the connecting pins are electrically connected with the terminals of the base member.

However, as the CPU becomes increasingly powerful, such as the Intel Pentium Series, heat dissipation becomes a critical factor for functional operation of the CPU. To address this problem, a heat sink and cooling fan assembly is commonly attached to an upper face of the CPU for dissipating heat generated therefrom to ensure normal operation of the CPU. However, operation of the cooling fan generates vibrations. Such vibrations are negligible when the heat sink and cooling fan assembly is small. Since, the heat sink and cooling fan assembly for the Intel Pentium series or other high performance CPU is comparatively large and heavy, the resulting vibrations adversely affect the electrical connection between the connecting pins of the CPU and the connecting terminals of the socket.

In order to solve this problem, a retainer is used to secure the CPU to a frame thereby ensuring proper electrical connection between the connecting pins of the CPU and the connecting terminals of the socket. However, when the CPU is held stationary, the conventional ZIF socket is of no use because it is impossible to move the connecting pins of the CPU by displacement of the cover member. Therefore, a new ZIF socket addressing this disadvantage is introduced wherein a typical one is disclosed in a contemporaneously filed application entitled "Electrical Apparatus" filed Aug. 21, 1998, and is assigned to the same assignee as the present invention.

SUMMARY OF THE INVENTION

An objective of this invention is to provide an electrical terminal mounted in a slide member for use with a ZIF socket which electrically connects connecting pins of a CPU to conductive pads of a printed circuit board.

In order to achieve the objective set forth, an electrical terminal in accordance with the present invention comprises a terminal body forming a leg portion at a lower portion thereof. The terminal forms at least a first connecting arm extending from a side of upper portion thereof. The connecting arm forms a first connecting portion and a second connecting portion for electrically connecting with different terminals.

According to another embodiment, a second connecting arm extends from the same side of the upper portion as the first connecting arm. The second connecting arm forms a second connecting portion for electrically connecting with a corresponding terminal.

These and additional objects, features, and advantages of the present invention will become apparent after reading the following detailed description of the preferred embodiments of the invention taken in conjunction with the appended drawings.

DETAILED DESCRIPTION OF PREFERRED EMBODIMENTS

Figure 1:
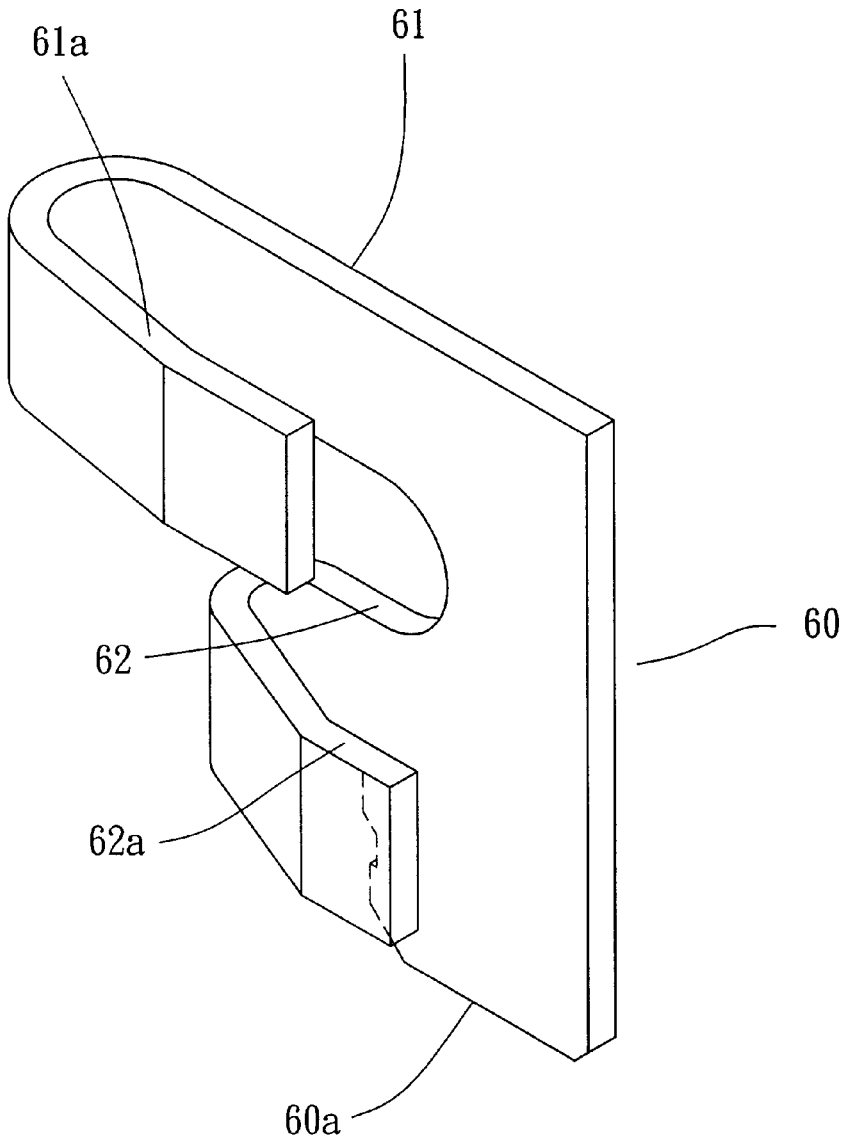
FIG. 1 is a perspective view of an electrical terminal in accordance with a first embodiment of the present invention.
Figure 2A:
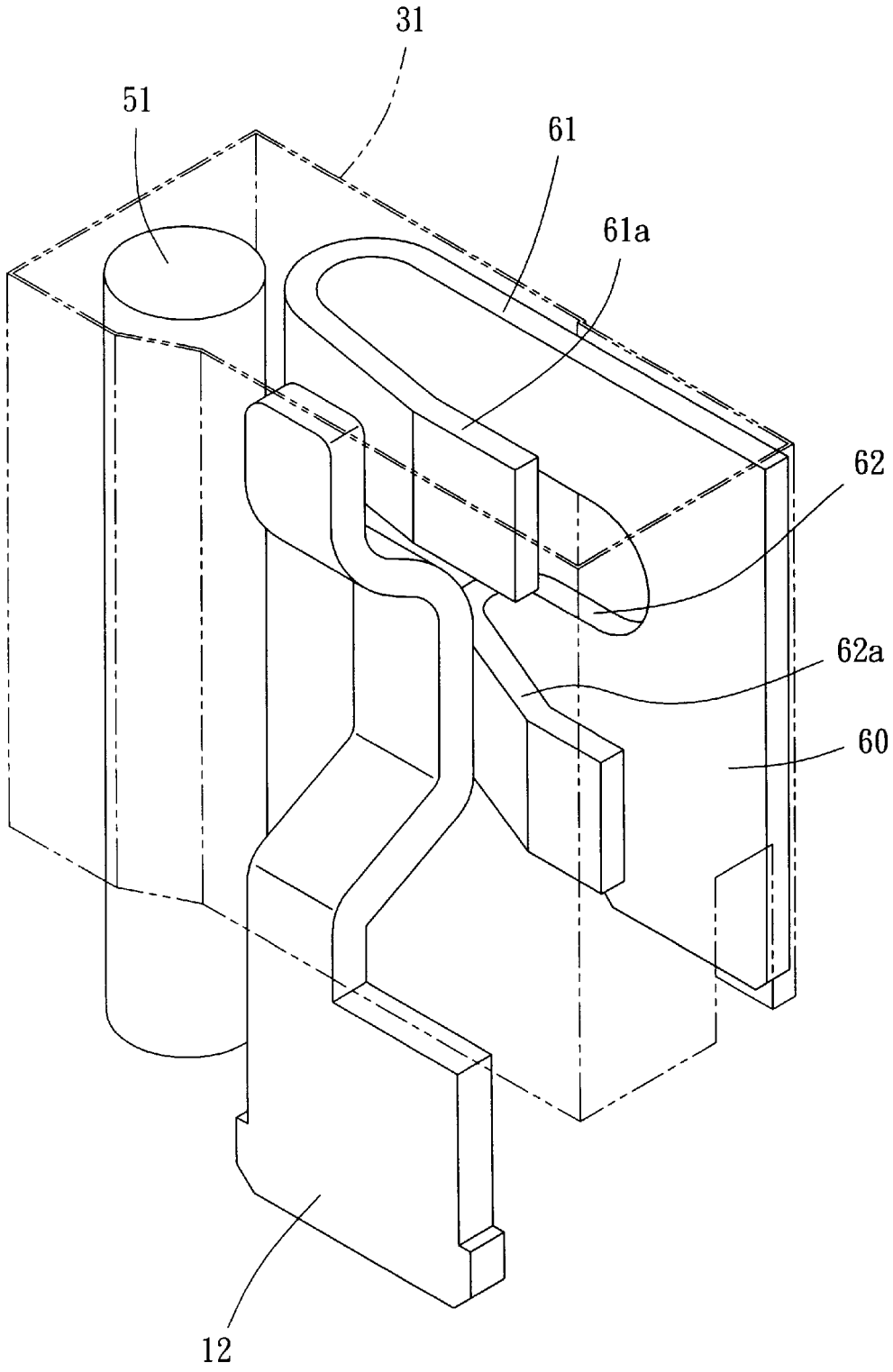
FIG. 2A is a schematic illustration showing a connecting pin of a CPU and a metal post of a base member not electrically connected by the electrical terminal of FIG. 1.
Figure 2B:
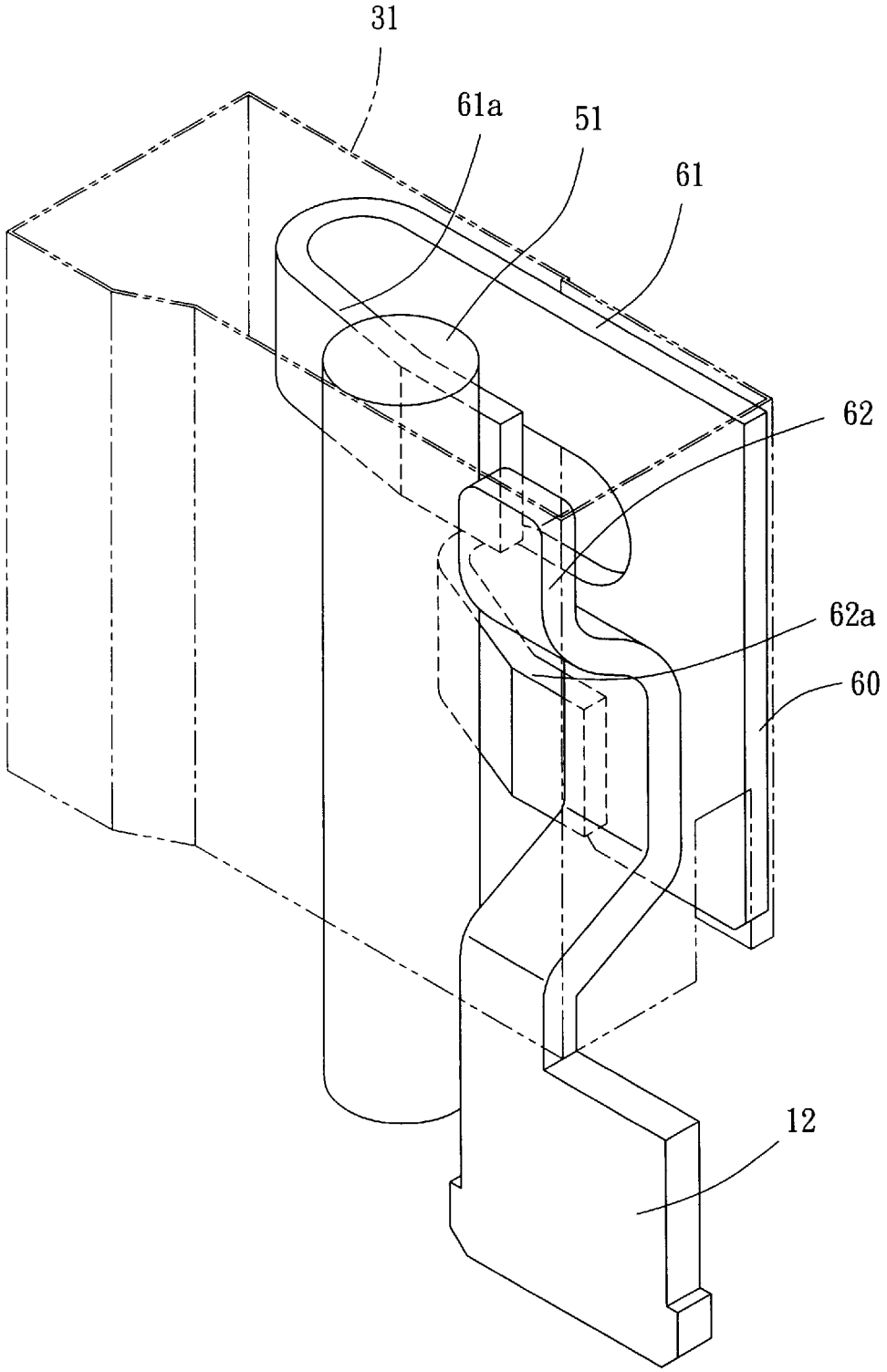
FIG. 2B is a schematic illustration showing the connecting pin of the CPU and the metal post of the base member electrically connected by the electrical terminal of FIG. 1.

Referring to FIGS. 1 , 2A, 2B, 5A, and 5B, an electrical terminal 60 in accordance with a first embodiment of the present invention comprises a leg portion 60*a* securely retained within a retaining recess of a slide member 30. The terminal 60 forms a first connecting arm 61 having a first flexible end 61*a*, and a second connecting arm 62 having a second flexible end 62*a*.

The ZIF socket 1 includes a base member 10, a cover member 20 securely engaged with the base member 10, and a slide member 30 movably received within a receiving slot (not labeled) defined between the cover member 20 and base member 10. The cover member 20 defines an array of through holes 21 for insertion of connecting pins 51 of the CPU. The base member 10 includes an array of metal posts 12 for electrically connecting with corresponding conductive pads of a printed circuit board (not shown). The slide member 30 defines an array of terminal cells 31 each securely receiving a terminal 60 therein. The slide member 30 is displaced by actuating means 40 between a first position and a second position. the CPU are easily inserted from the through holes 21 into the corresponding terminal cells 31. In this situation, the connecting pin 51 and the metal post 12 are not electrically connected.

When the slide member 30 is moved to the second position by the actuating means 40, the terminals 60 are also moved along with the terminal cells 31 whereby the first flexible end 61*a* of the first connecting arm 61 electrically connects with the connecting pin 51 of the CPU, and the second flexible end 62*a* of the second connecting arm 62 electrically connects with the metal post 12 of the base member 10. Accordingly, the connecting pins 51 are electrically connected with the metal post 12 which is soldered to a printed circuit board (not shown).

It can not noted that within each terminal cell 31, because of the limited space, the connecting pin 51 and the metal post 12 are juxtaposed on the same lengthwise side along the moving direction of the slide member 30, and the terminal 60 is positioned on the other opposite lengthwise side. Therefore, through the lengthwise movement of the slide member 30 from the first position to the second position, the connecting pin 51 and the metal post 12 can be electrically connected with each other by means of the interface terminal 60.

Figure 3:
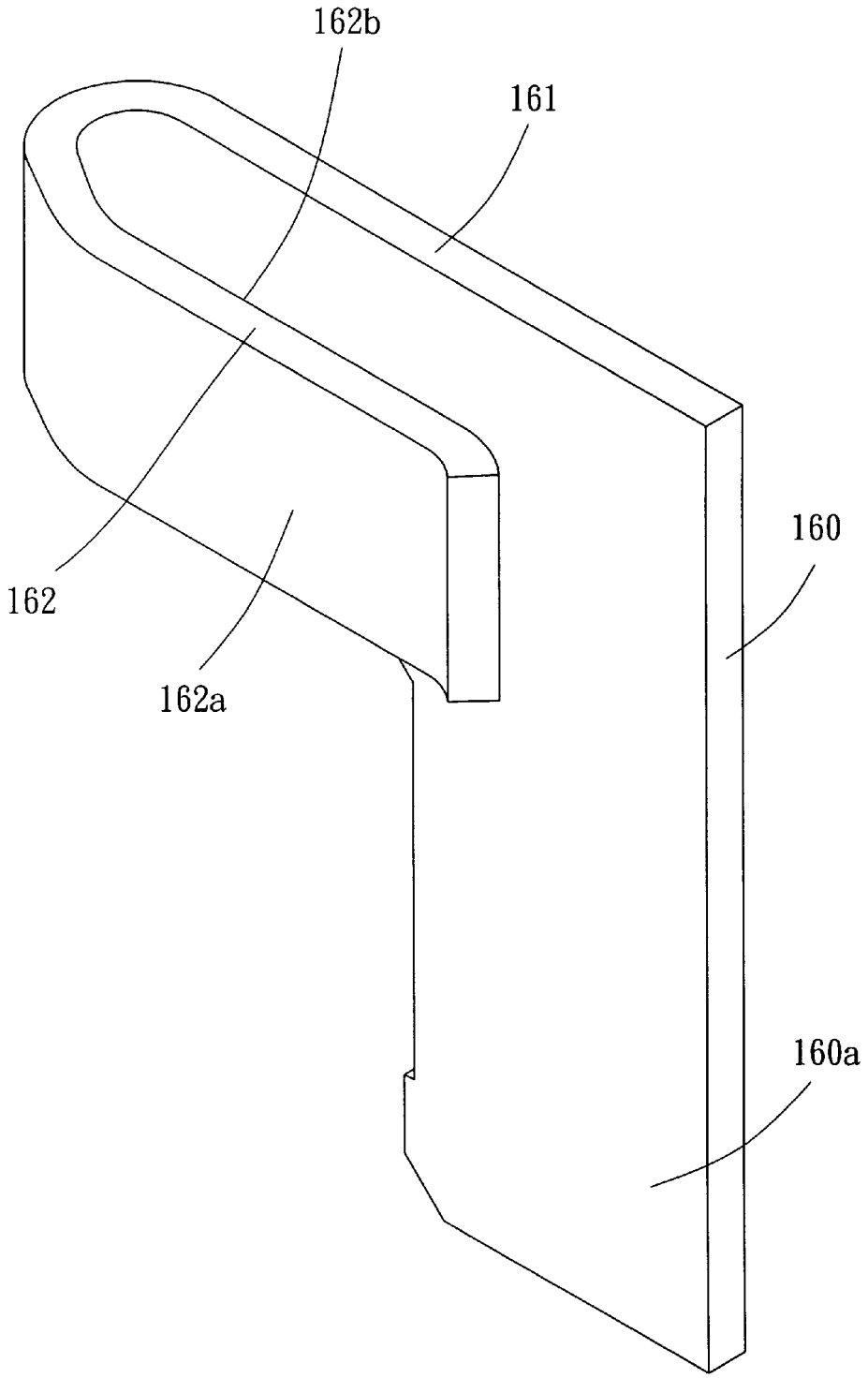
FIG. 3 is a perspective view of an electrical terminal in accordance with a second embodiment of the present invention.

A second embodiment of a terminal 160 in accordance with the present invention is shown in FIG. 3. The terminal 160 includes a leg portion 160*a* which is securely retained within a retaining recess of the slide member 30. The terminal 160 forms a connecting arm 161 with a flexible end 162 having an outer contacting face 162*a* and an inner contacting face 162*b*.

Figure 4A:
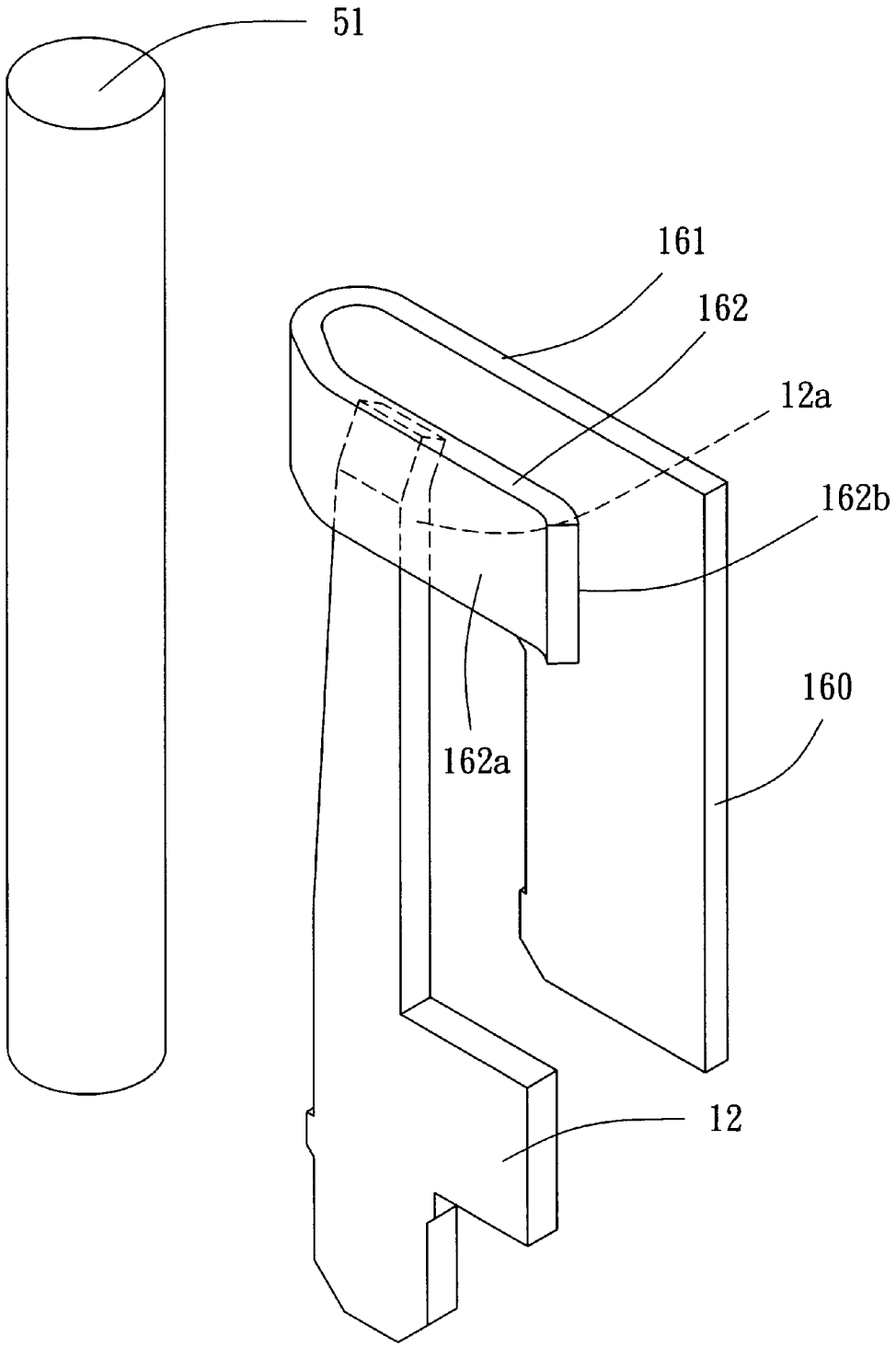
FIG. 4A is a schematic illustration showing the connecting pin of the CPU and the metal post of the base member not electrically connected by the electrical terminal of FIG. 3.
Figure 4B:
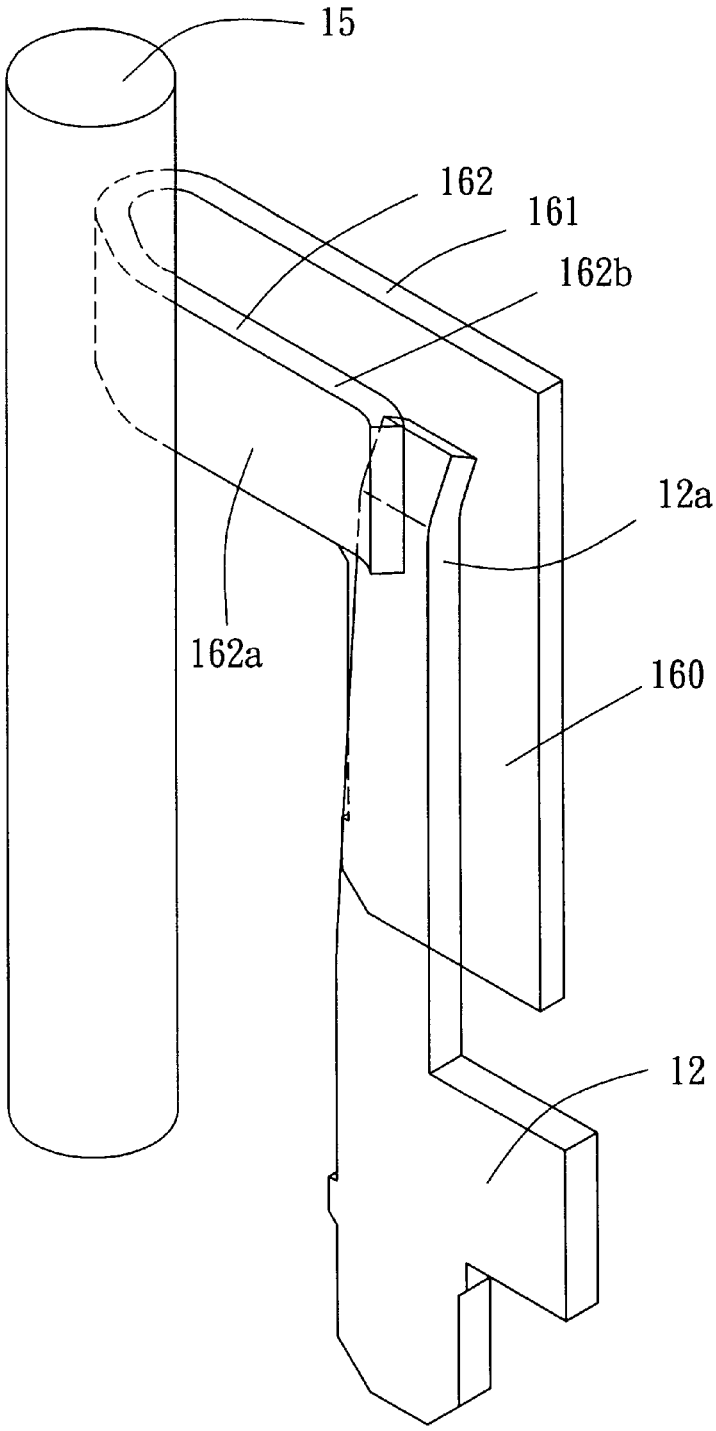
FIG. 4B is a schematic illustration showing the connecting pin of the CPU and the metal post of the base member electrically connected by the electrical terminal of FIG. 3.
Figure 5A:
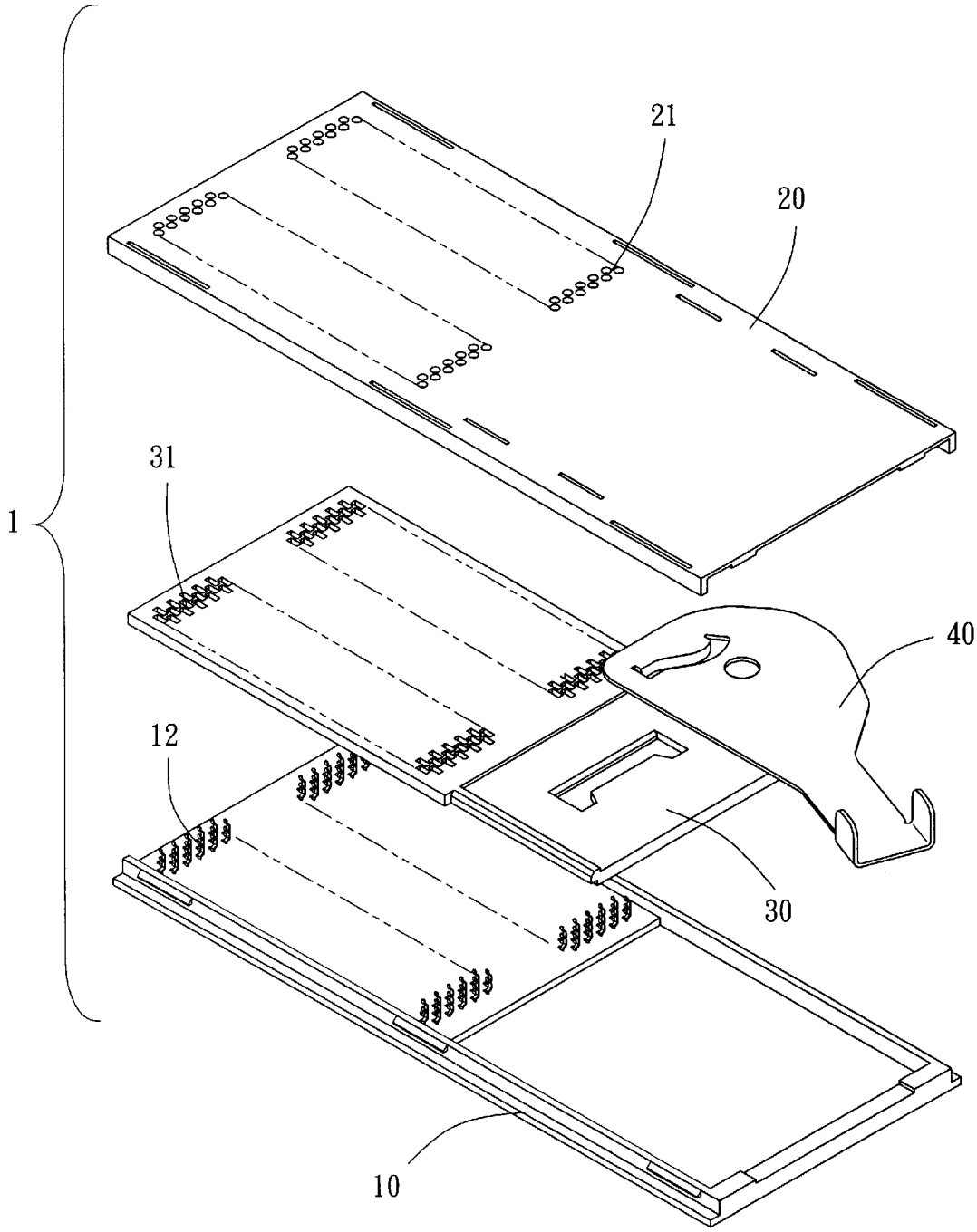
FIG. 5A is an exploded view of a ZIF socket in which the terminal in accordance with the present invention is used.
Figure 5B:
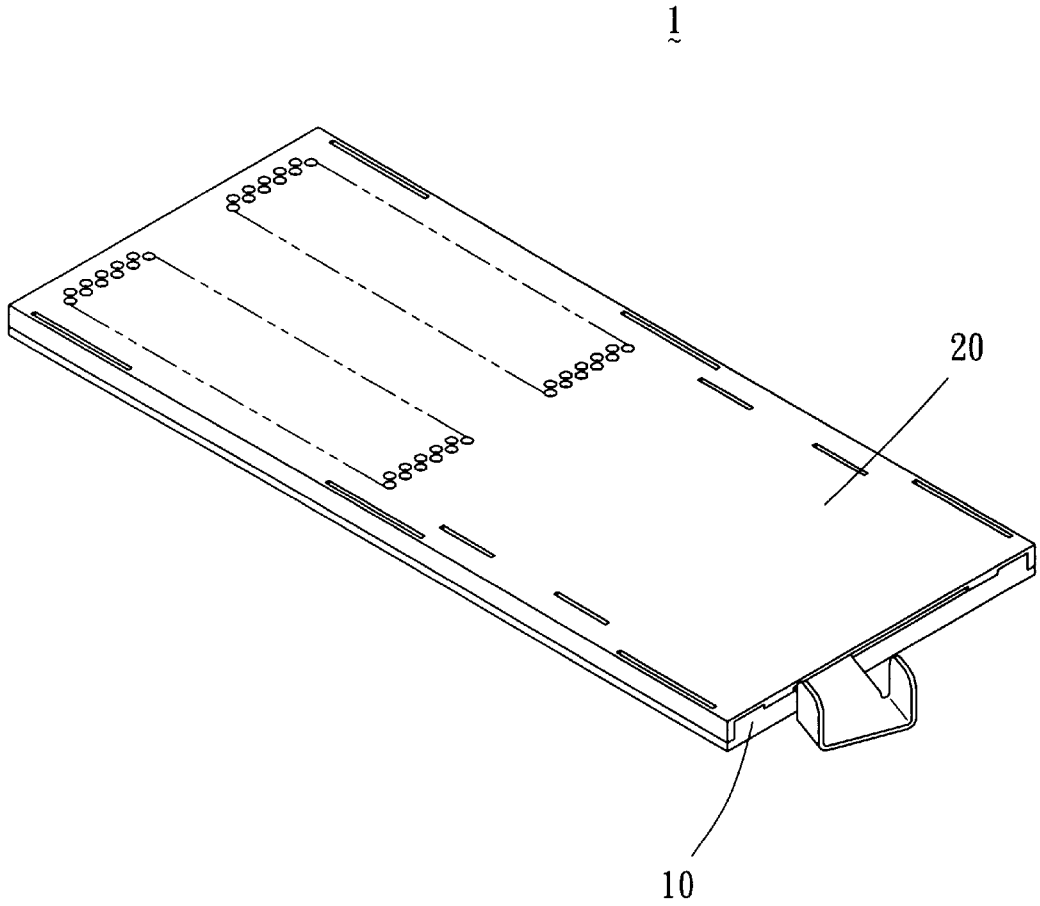
FIG. 5B is an assembled view of the ZIF socket of FIG. 5A.

Referring to FIGS. 4A and 4B, a tip 12*a* of the metal post 12 is in constant contact the inner contacting face 162*b* of the connecting arm 161 whether the slide member 30 is at in the first or second position. However, the outer contacting face 162*a* is not connected with the connecting pin 51 of the CPU when the slide member 30 is at the first position. The outer contacting face 162*a* of the first connecting arm 161 connects with the connecting pin 51 when the slide member 30 is positioned at the second position thereby creating a short conducting path between the connecting pin 51, the terminal 160, and the metal post 12.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. An electrical terminal for use with a ZIF socket for electrically connecting a CPU to a printed circuit board, comprising a terminal body forming a leg portion at a lower portion thereof, said terminal forming a first connecting arm and a second connecting arm, which is shorter than the first connecting arm extending horizontally from a side of an upper portion thereof and spaced from said terminal body, said first connecting arm forming a first connecting portion and a second connecting portion for electrically connecting different terminals.

2. An electrical terminal as recited in claim 1, wherein said first connecting portion is an outer face of said first connecting arm, and said second connecting portion is an inner face of said first connecting arm.

3. An electrical terminal as recited in claim 1, wherein said second connecting portion is electrically connected with a first terminal.

4. An electrical terminal as recited in claim 1, further comprising a second connecting arm extending from the same side of said upper portion as said first connecting arm for electrically connecting with a corresponding second terminal.

5. An electrical terminal for use with a ZIF socket for electrically connecting a CPU to a printed circuit board, comprising a terminal body forming a leg portion at a lower portion thereof, said terminal forming a first connecting arm and a second connecting arm, which is shorter than said first connecting arm, extending horizontally from a side of an upper portion thereof and spaced from said terminal body, each of said first and second connecting arms forming a connecting portion for electrically connecting with a corresponding terminal.

6. An electrical terminal as recited in claim 5, wherein said first and second connecting arms are parallel to each other.

7. An electrical terminal as recited in claim 5, wherein said connecting portions of said first and second arms are offset from each other.

8. An arrangement of electrically connecting a connecting pins extending from a stationary CPU and metal posts soldered on a stationary PC board, comprising:

a slide member being horizontally moveable relative to both said CPU and said PC board, said slide member including a plurality of terminal cells in each of which a terminal is received; wherein a connecting pin and a metal post are juxtaposed on one lengthwise side of each of the terminal cells along a movement direction of the slide member, and the corresponding terminal is positioned on an opposite lengthwise side; whereby through the movement of the slide member along the lengthwise direction, in each terminal cell, said connecting pin and said post can be electrically connected with each other by respective engagement with the corresponding terminal in the same terminal cell.

* * * * *